United States Patent [19]

Illgner

[11] Patent Number: 4,662,134

[45] Date of Patent: May 5, 1987

[54] CRYOGENIC WEDGE-TYPE ANCHOR FOR STRANDED TENSION CABLES

[75] Inventor: Wolfram Illgner, Friedberg, Fed. Rep. of Germany

[73] Assignee: Philipp Holzmann AG, Frankfurt am Main, Fed. Rep. of Germany

[21] Appl. No.: 780,371

[22] Filed: Sep. 26, 1985

[30] Foreign Application Priority Data

Oct. 19, 1984 [DE] Fed. Rep. of Germany ..... 3438355

[51] Int. Cl.[4] ..... E04C 3/10

[52] U.S. Cl. ..... 52/223 R; 52/223 L; 403/371

[58] Field of Search ..... 52/223 R, 223 L; 403/371

[56] References Cited

U.S. PATENT DOCUMENTS

| | | | |
|---|---|---|---|
| Re. 27,954 | 4/1974 | Kelly | 52/223 L |
| 2,009,318 | 7/1935 | Highfield | 403/371 X |
| 2,177,364 | 10/1939 | Fotsch | 403/371 X |
| 3,703,748 | 11/1972 | Kelly | 52/223 L |

FOREIGN PATENT DOCUMENTS

| | | | |
|---|---|---|---|
| 2262120 | 6/1974 | Fed. Rep. of Germany | 52/223 L |
| 2357819 | 5/1975 | Fed. Rep. of Germany . | |
| 2720788 | 11/1978 | Fed. Rep. of Germany . | |
| 3225723 | 1/1984 | Fed. Rep. of Germany | 52/223 R |
| 3236614 | 4/1984 | Fed. Rep. of Germany | 52/223 R |
| 549161 | 11/1942 | United Kingdom . | |

*Primary Examiner*—William F. Pate, III
*Assistant Examiner*—Caroline D. Dennison
*Attorney, Agent, or Firm*—Wyatt, Gerber, Shoup, Scobey & Badie

[57] ABSTRACT

A wedge-type anchor for stranded tension cables. It has anchoring wedges that rest in a conical wedge-reception bore in a wedge mount. The wedges have teeth on their inner surface that decrease in depth toward the point of the wedge. To allow the anchor to be utilized at cryogenic temperatures without the core sliding through and the outer strands breaking prematurely, the ratio of the pitch (8) of the teeth to the diameter of the cable is between 1:20 and 1:30 at a ratio of the effective compression length (11) of each anchoring wedge (4) to the diameter (5) of the cable of between 2.8 and 4.5, and the teeth at the point of the wedge have a contact surface that tapers at an angle (13) of 4° to 6° to the longitudinal axis.

4 Claims, 3 Drawing Figures

CRYOGENIC WEDGE-TYPE ANCHOR FOR STRANDED TENSION CABLES

BACKGROUND OF THE INVENTION

1. Field of the Invention

The invention relates to a wedge-type anchor for stranded tension cables.

2. Description of the Related Art

Stranded tension cables are almost exclusively anchored with wedge systems that involve longitudinally segmented wedges with hardened teeth on the inside (e.g. German OS No. 2 720 788). The relatively hard points of the teeth dig into the cable as it is tensioned and create both a frictional and mechanical connection between the cable and the wedge.

The anchoring systems utilized in the present context—for securing prestressed-concrete sections that are employed for example in tanks for storing liquefied gas and are subjected to very low temperatures—encounter problems as a result of the very high notch sensitivity of the cable material even though a number of tension steels with satisfactory strength along their total length even at cryogenic temperatures are available. Notch sensitivity can at very low temperatures lead to premature fracture of the steel. The fracture occurs in the vicinity of the anchor, usually without plastic deformation of the steel along its free length. Thus the safety standard for pretensioned structures that the steel should have satisfactory overall strain (elongation) in the computed fracture state is not complied with. This demand for a plastic strain component can be complied with only when the yield point of the steel is considerably exceeded at cryogenic temperature.

At very low temperatures there is another problem in the design of the cables that are to be anchored. The cable usually consists of six outer wires and one core. The outer wires are in direct contact with the wedge in the vicinity of the anchor, whereas the core is secured only by friction with the outer wires. Transverse pressure is communicated linearly from the outer strands to the core. When the cable is subjected to high tensile load and accordingly higher transverse pressure at room temperature, the wires will deform and increase the contact surfaces. The strain hardening that occurs at very low temperatures prevents or at least inhibits the deformation that develops at room temperature and high tensile load and increases the contact surfaces. The core will consequently slip prematurely and become deprived of support in the accommodation of force. If the core slips completely or almost completely out of the wedge, the anchor will suddenly fail. If the core catches again inside the wedge, the outer strands will be overloaded and will break prematurely.

Wedge-type anchors in which the transverse pressure (compression) and hence the depth that the teeth penetrate to are supposed to increase gradually from the thin end or point of the segmented wedge are state of the art. Thus, in one known wedge-type anchor, the increase in compression from the point of the wedge is generated by preventing the parts at the thin end of the wedge from resting against the wall of the wedge mount (German OS No. 2 720 788). Tapering the bore that accommodates the wedge outward at a section that has a lower angle of inclination than the main section has also been disclosed in this context. To generally obtain a "weaker" grip on the tensioning member of a wedge anchor, it is also state of the art to decrease the slipresistance of the inner surface of the wedge that is in contact with the member at the thinner end of the wedge (German OS No. 2 357 819). This can be done in particular by decreasing the height and shape of the gripping projections cast onto the inner surface of the wedge toward its thinner end. The gripping projections are, specifically, helical serrations with a pitch that decreases continuously from the thicker to the thinner end of the wedge. They are of course expensive to produce.

Finally, a fastener for stranded tension cables that involves wedge-shaped elements with engagement projections cast onto the surfaces that come into contact with the cable and decreasing as in the aforesaid anchor from the thicker to the thinner end of the wedge (GG Pat. No.549 616) is also known. These projections actually disappear two thirds of the way along the wedge, which is about seven times the total diameter of the cable. The angle of outside inclination of the wedge-shaped elements can be sharper than the angle of inside inclination of an associated sleeve. This type of anchor requires a long wedge to hold the tension member securely. It is accordingly relatively expensive, the more so because the wedge-shaped elements have to be reinforced at their narrow end with an additional continuous ring.

None of these known wedge anchors, however, are designed to comply with the special demands associated with anchors that are to be exposed to cryogenic temperatures.

SUMMARY OF THE INVENTION

The object of the present invention is to provide an easily manufactured wedge-type anchor of the type initially discussed, in which the tension member, specifically the stranded tension cable, will exhibit definite plastic expansion when under load in the fracture state at cryogenic temperatures.

An essential characteristic of this wedge-type anchor is the special tooth structure with its constant pitch in the stated range of dimensions and with a prescribed contact surface taper, which, in conjunction with the proposed effective compression length, ensures reliable retention of the core without significant notching of the outer wires subject to the requisite transverse pressure when employed as intended at very low temperatures. This type of anchor is also very easy to manufacture because the teeth with their uniform pitch can be ausforged over the length of the wedge and because the anchor is not very long overall.

BRIEF DESCRIPTION OF THE DRAWINGS

One embodiment of the invention will now be described with reference to the drawing, in which.

DESCRIPTION OF THE PREFERRED EMBODIMENT

The contact surface of the teeth tapers out at an angle of 4° to 6° to the longitudinal axis. This dictates in conjunction with the pitch dimensions recited in claim 1 the length of the contact surface. Hence, the outer wires of the cable will be notched even at cryogenic temperatures only to the extent that tension introduced into the anchor by the tension member (the cable) is released, with, however, the total wedge being kept short because the teeth do not begin immediately behind its point. The anchor is economical to manufacture because it is relatively short.

The contact-surface taper is preferably carried out in such a way as to make the wedge as short as possible.

The relation between the angle of inclination within the wedge-reception bore and the angle of inclination at the back of the wedge prevents transverse pressure at the point of the wedge from being highest as the result of manufacturing tolerances where the cable still exerts complete tension. This will also counteract the tendency to provide deeper tooth engagement into the strand only where the tension is already diverted to one part of the cable. A greater difference between the angles of inclination has, however, turned out to be impractical because it would necessarily result in varying transverse pressure along the compression length. The core of the cable would accordingly not, as in the object of the invention, be compressed with uniform force in the anchoring range, and the vicinity of the point of the wedge might become extensively ineffective for anchoring the core, the more so in that the strands of the cable deform only to a very limited extent at cryogenic temperatures.

The easy to manufacture design of the anchor, including the surface roughness of the wedge-reception bore and the back of the wedge that can be achieved without additional manufacturing steps, counteracts the especially destructive tendency of the wedge to jerk its way into the bore. Such a rough pull can overstress the strands and cause them to break prematurely. The tendency to do so at cryogenic temperatures can be ascribed to irregularities in the wedge-reception bore no longer being evened out by the harder wedge back as the result of material hardening. When the surface roughness is dimensioned as described herein, approximately equal for both the bore and the wedge back, the wedge will be drawn in, as has been demonstrated, smoothly.

Figure 1:
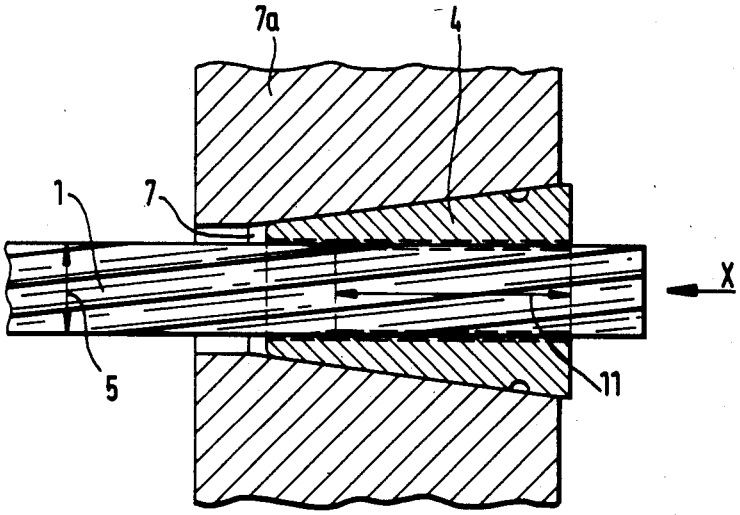
FIG. 1 is a longitudinal section through a wedge-type anchor.
Figure 2:
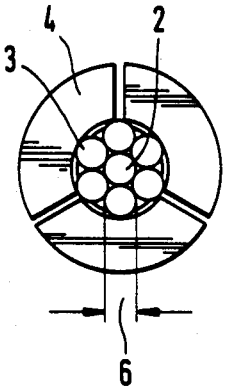
FIG. 2 is a view of the anchor from the direction X in FIG. 1 but without the wedge-reception bore; and through the bore and the point of the wedge, with the pitch not necessarily to scale.

The stranded tension cable 1 in FIG. 1 consists as will be evident from FIG. 2 of a core 2 and six outer strands 3. Cable 1 is intended to be compressed by three anchoring wedges 4 in the form of segments of a round wedge into the wedge-reception bore 7 of an anchor plate 7*a* that functions as an anchoring body.

The effective compression length 11 is indicated by the double-headed arrow in FIG. 1. The effective compression length is the section along which the teeth are fully formed. It is at least 2.8 times the diameter 5 of cable 1 but for reasons of economy no more than 4.5 times the diameter.

Figure 3:
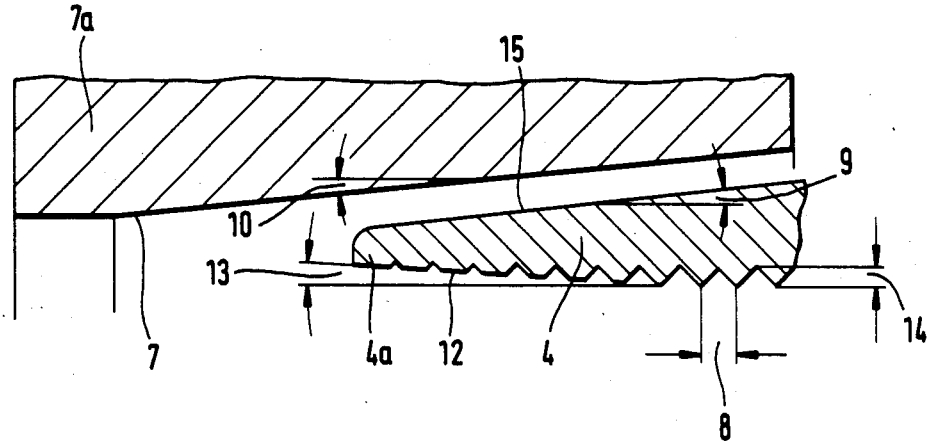

The other dimensional relationships will be most evident from FIG. 3. There are teeth on the inner surface of each anchoring wedge 4. The pitch 8 of the teeth is constant and they have a maximal depth 14. The teeth extend at maximal depth 14 as far as the end of anchoring wedge 4 that is not illustrated in FIG. 3. Thus, pitch 8 extends constant as far as wedge point 4*a* and vanishes at that point only as the result of a tapered contact surface 12.

Apart from these dimensional relationships, the ratio of pitch 8 to the diameter 5 of cable 1 is between 1:20 and 1:30 and, to the diameter 6 of an individual strand, between 1:6.5 and 1:10.

Contact surface 12 tapers out at point 13, at wedge point 4*a* that is, to an extent that equal maximal tooth depth 14.

The angle of taper at point 13 is between 4° and 6°. The extent and angle of taper dictates the length of contact.surface 12, which is not indicated.

FIG. 3 also illustrates the angle 9 of inclination of the back 15 of anchoring wedge 4 and the angle 10 of inclination of wedge-reception bore 7. Angle 9 should be about 0.2° to 0.3° wide than angle 10.

To prevent anchoring wedge 4 from jerking into wedge-reception bore 7, the bore is relatively smooth, having an ISO roughness class of at Least $N_8$ ($R_a$3.2 μm), and the back 15 of anchoring wedge 4 has an ISO roughness class of at least $N_6$ ($R_a$0.8 μm), which also allows for a mean roughness of $R_a$0.8 μm without expensive finishing processes. Greater deviations in the surface roughness of either the bore or the wedge back should be avoided.

I claim:

1. Wedge-type anchor for stranded tension cables with anchoring wedges that rest in a conical wedge-reception bore in a wedge mount, the bore having an imaginary longitudinal axis and the wedges having teeth on their inner surface that decrease in depth toward the point of the wedge, characterized in that the anchor is at a cryogenic temperature, the ratio of the pitch (8) of the teeth to the diameter of the cable is between 1:20 and 1:30 and the ratio of the effective compression length (11) of each anchoring wedge (4) to the diameter (5) of the cable is between 2.8 and 4.5 and in that the teeth at the point of the wedge have a contact surface that tapers at an angle (13) of 4° to 6° to the longitudinal axis.

2. Wedge-type anchor as in claim 1, characterized in that the contact surface tapers at the point of the wedge to an extent that is equal to a (maximal) tooth depth (14).

3. Wedge-type anchor, as in claims 1 or 2, in which the angle of inclination of the wedge-reception bore is more acute than that of the wedges, characterized in that the angle (9) of inclination of the back (15) of the anchoring wedge is about 0.2° to 0.3° wider than the angle (10) of inclination of the wedge-reception bore (7).

4. Wedge-type anchor as in one of claims 1 through 3, characterized in that the surface roughness (mean roughness) of the wedge-reception bore (7) is no higher than $R_a$=3.2 μm (ISO roughness class $N_8$) and the surface roughness (mean roughness) of the back (15) of the anchoring wedge is no higher than $R_a$=0.8 μm (ISO roughness class $N_6$).

* * * * *